US006163916A

United States Patent [19]

Terui et al.

[11] Patent Number: 6,163,916

[45] Date of Patent: Dec. 26, 2000

[54] CLEANING APPARATUS FOR DISK-SHAPED WORKPIECES

[75] Inventors: Yoshinobu Terui; Hiroji Sato, both of Ayase, Japan

[73] Assignee: Speedfam Clean System Co., Ltd., Ayase, Japan

[21] Appl. No.: 09/337,728

[22] Filed: Jun. 22, 1999

[30] Foreign Application Priority Data

Jul. 9, 1998 [JP] Japan ..... 10-194129

[51] Int. Cl.[7] ..... B08B 3/00; B08B 3/12

[52] U.S. Cl. ..... 15/102; 15/88.3

[58] Field of Search ..... 15/88.2, 88.3, 15/77, 102

[56] References Cited

U.S. PATENT DOCUMENTS

| | | | |
|---|---|---|---|
| 5,868,857 | 2/1999 | Moinpour et al. | 15/102 |
| 5,875,507 | 3/1999 | Stephens et al. | 15/88.3 |
| 5,975,094 | 11/1999 | Shurtliff | 15/88.3 |
| 6,052,855 | 4/2000 | Terui | 15/88.3 |
| 6,082,377 | 7/2000 | Frey | 15/102 |
| 6,101,656 | 8/2000 | Lee et al. | 15/102 |

FOREIGN PATENT DOCUMENTS

| | | |
|---|---|---|
| 61-8734 | 1/1986 | Japan . |
| 3-93040 | 4/1991 | Japan . |
| 4-22411 | 5/1992 | Japan . |
| 9-299895 | 11/1997 | Japan . |

*Primary Examiner*—Terrence R. Till
*Attorney, Agent, or Firm*—Oblon, Spivak, McClelland, Maier & Neustadt, P.C.

[57] ABSTRACT

A cleaning apparatus for cleaning disk-shaped workpieces while positively rotating them by a large driving force is equipped with a simple, efficient driving means, a cleaning mechanism 18 for cleaning workpieces W individually formed of an endless driving belt 19 for forcibly rotating a workpiece around an axis, and a pair of cleaning rollers 20 and 20 for clamping both surfaces of a rotating workpiece W from both sides to clean it, the driving belt 19 being curved in the circumferential direction of the workpiece W so as to be brought into linear contact with the outer periphery of the workpiece W.

9 Claims, 9 Drawing Sheets

CLEANING APPARATUS FOR DISK-SHAPED WORKPIECES

FIELD OF THE INVENTION

The present invention relates to an apparatus for cleaning substantially disk-shaped workpieces such as magnetic disk substrates or optical disk substrates, silicon wafers, glass wafers, etc.

DESCRIPTION OF THE RELATED ART

A scrubbing-type cleaning apparatus that cleans disk-shaped workpieces by roller cleaning members has been hitherto known as described in, for example, Japanese Unexamined Patent Publication No. 61-8734, Japanese Examined Patent Publication No. 7-14509, etc.

In general, this type of cleaning apparatus is configured to bring a hard drive roller having a small diameter into contact with the outer periphery of a workpiece and to clean the surface of the workpiece by the roller cleaning member while forcibly rotating the workpiece around an axis by the drive roller.

However, according to the method wherein the drive roller having a small diameter is brought in contact with the outer periphery of a workpiece to rotate it, contact between the drive roller and the workpiece is a point contact; hence, there has been a problem in that it is difficult to transfer the torque of the drive roller to the workpiece, frequently leading to rotation failures due to slippage. In addition, the phenomenon in which the drive roller slips, as mentioned above, becomes more pronounced as the surface pressure (pressing force) of the cleaning member acting on the workpiece increases; therefore, the surface pressure cannot be increased very much, partly contributing to deterioration of cleaning effects.

The slippage problem mentioned above can be solved to a certain extent by providing a plurality of drive rollers; however, the plural drive rollers must be installed with appropriate intervals provided therebetween in a small portion of a cleaning tank, and it is difficult to secure such a space for installation. In addition, each of the plurality of drive rollers positioned at intervals must be coupled to a drive source, complicating the structure of the apparatus, and presenting problems in that these drive rollers, coupling mechanisms, etc., would obstruct the transfer of workpieces, the disposition of the cleaning members, or the like. There is also a shortcoming in that the contact with the hard drive rollers tends to cause damage to the outer peripheries of workpieces.

DISCLOSURE OF THE INVENTION

A primary object of the present invention is to provide a cleaning apparatus equipped with a simple, efficient driving means, and which is capable of cleaning a workpiece while securely rotating the workpiece with a large driving force.

Another object of the present invention is to provide a cleaning apparatus equipped with a belt-type driving means, and which is capable of safely and positively rotating a workpiece being cleaned, without damaging the workpiece.

To attain these objects, according to the present invention, there is provided a cleaning apparatus equipped with at least one cleaning mechanism for cleaning disk-shaped workpieces individually. The cleaning mechanism is characterized in that it includes an endless driving belt that forcibly rotates the workpieces around an axis, and a plurality of cleaning rollers that clamp both surfaces of the rotating workpiece from both sides and clean the workpieces, and the driving belt is provided such that it is curved in the circumferential direction of the workpieces so as to have linear contact with the outer peripheries of the workpieces.

According to the cleaning apparatus of the present invention having the configuration set forth above, the endless driving belt is used to drive workpieces, and the driving belt is adapted to have linear contact with the outer peripheries of the workpieces; therefore, it is possible to reliably transmit the driving force of the belt to the workpieces so as to reliably rotate the workpieces with a large driving force compared with the conventional method in which the drive roller having a small diameter makes point contact with workpieces. As a result, it becomes possible to enhance cleaning effects by increasing the surface pressure of the cleaning roller according to the type of workpiece or other cleaning conditions. Moreover, a flexible driving belt is in linear contact with the workpieces, minimizing the chance of damage to the workpieces.

According to a specific construction, at least one pair of cleaning rollers are provided at positions across and opposing each other such that they hold a workpiece therebetween and press the workpiece against the driving belt by torque during cleaning.

Thus, having the cleaning rollers also serving as the pressing means obviates the need of providing supporting rollers or the like dedicated to rotatably supporting workpieces while cleaning them; hence, the configuration of the cleaning apparatus is simplified.

The cleaning apparatus in accordance with the present invention may have a configuration in which workpieces are cleaned while they are immersed in a flowing cleaning solution, or a configuration in which workpieces are cleaned by spraying a cleaning solution on the works through a nozzle.

Furthermore, according to a preferred embodiment of the present invention, in order to permit automatic, continuous cleaning of workpieces, there is provided along a cleaning tank, wherein a cleaning solution continuously flows from one direction to the other direction, one or more cleaning assemblies having at least one cleaning mechanism that includes the driving belt and cleaning rollers, a loading assembly for supplying uncleaned workpieces to the cleaning assembly, and an unloading assembly for removing cleaned workpieces from the cleaning assembly, a workpiece holder being provided for sequentially conveying workpieces to and from the loading assembly, the cleaning assembly, and the unloading assembly.

DETAILED DESCRIPTION OF THE PREFERRED EMBODIMENTS

Figure 1:
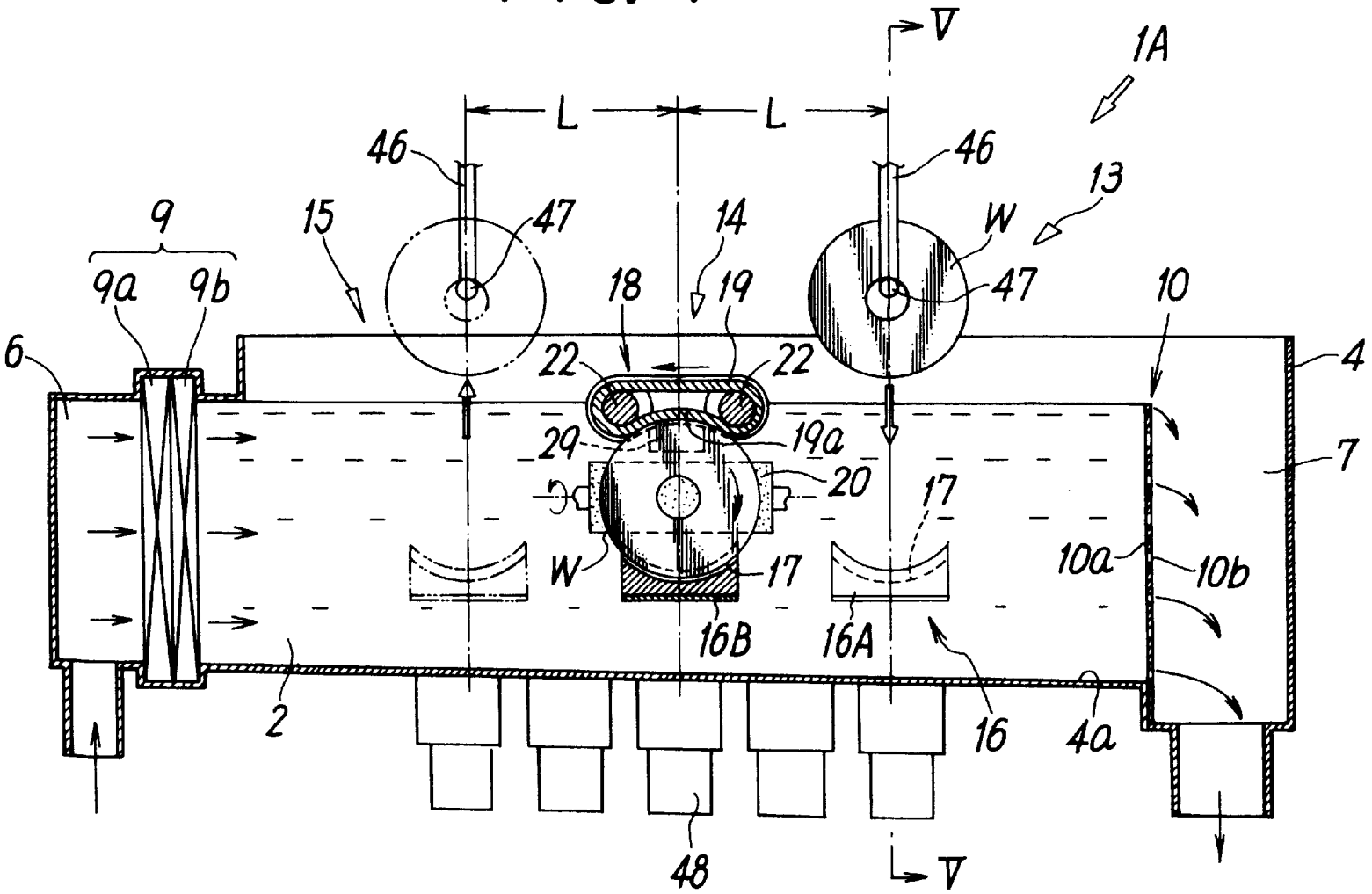
FIG. 1 is a sectional view schematically showing a first embodiment of a cleaning apparatus in accordance with the present invention, employing only major component parts.

A preferred embodiment of the present invention will now be described in detail with reference to the accompanying drawings. FIG. 1 schematically shows a cleaning apparatus 1A of a first embodiment, using only major component parts, and FIG. 2 through FIG. 6 show specific configurations thereof. The cleaning apparatus 1A cleans disk-shaped workpieces W individually by scrubbing them in the flow of a cleaning solution 2 while automatically and continuously conveying them.

The cleaning apparatus 1A is provided with a solution-flow-type cleaning tank 4 supported by a machine body 3. The cleaning tank 4 is generally trough-shaped and has a solution supply section 6 at one end thereof to supply a cleaning solution 2, and a solution drainage section 7 at the other end thereof to drain the cleaning solution 2. The cleaning solution 2, consisting of pure water, a detergent solution, or a chemical solution or the like, is continuously passed from the solution supply section 6 toward the solution drainage section 7. A bottom section 4*a* of the cleaning tank 4 is slightly inclined in a direction such that the solution drainage section 7 is lower than the solution supply section 6.

The solution supply section 6 and solution drainage section 7 are provided with rectifying mechanisms 9 and 10, respectively, that are formed of porous plates to make the flow of the cleaning solution 2 substantially uniform over the full solution depth.

The rectifying mechanism 9 on the side of the solution supply section 6 is formed of a plurality of fiber plates 9*a* and 9*b* having different porosities, the fiber plates 9*a* with a lesser porosity being provided on the upstream side from the fiber plates 9*b* having larger porosity. Furthermore, the cleaning solution 2 is supplied under pressure through the fiber plates 9*a* and 9*b* from the solution supply section 6 having a hermetically sealed structure, thereby providing a substantially uniform flow velocity over the full solution depth.

Moreover, the rectifying mechanism 10 on the side of the solution drainage section 7 is formed of metallic punched plate 10*a* having numerous flow apertures 10*b*, the upper end of the punched plate 10*a* being provided such that a part of the cleaning solution 2 overflows, while the rest passes through the flow apertures 10*b* to flow out to the solution drainage section 7.

New cleaning solution may be constantly supplied from a supply source to the solution supply section 6. Alternatively, a solution supply mechanism equipped with a purifying function for a cleaning solution may be connected between the solution supply section 6 and the solution drainage section 7 to collect and purify used cleaning solution for recycling.

In the above cleaning tank 4, a loading assembly 13 for supplying uncleaned workpieces, a cleaning assembly 14 for cleaning supplied workpieces, and an unloading assembly 15 for taking out cleaned workpieces are installed in this order from the downstream side along the flow of the cleaning solution 2, equal intervals L being provided therebetween. A plurality of workpiece holders 16 for conveying the workpieces W between the sections while holding them longitudinally and in parallel to a liquid current is provided inside the cleaning tank 4.

The cleaning assembly 14 is provided with a cleaning mechanism 18 for cleaning the workpieces W individually. The cleaning mechanism 18 includes an endless driving belt 19 that forcibly rotates the workpieces W around an axis in the cleaning solution 2 and a plurality of cleaning rollers 20 that clamp both surfaces of the rotating workpieces W from both sides for cleaning them in the cleaning solution 2.

The driving belt 19 is wound on pulleys 22 having a plurality of grooves and is driven in the lapping direction. A lower belt portion 19*a* provides a driving portion curved in the circumferential direction of the workpieces W, and the driving portion 19*a* is disposed to be in linear contact with the upper outer periphery of a workpiece W. The driving belt 19 is composed of a constituent such as a rubber, synthetic rubber, or synthetic resin which is flexible so as not to damage the workpieces and which has a high coefficient of friction; it is provided with a circumferential recess 19*b* in an outer peripheral face thereof, and the recess 19*b* abuts against the outer periphery of the workpiece W, as can be seen in FIG. 6.

Thus, the endless driving belt 19 is used to drive the workpiece W, and the driving belt 19 is adapted to be in linear contact with the outer periphery of the workpiece; therefore, it is possible to reliably transmit the driving force of the driving belt 19 to the workpiece so as to reliably rotate the workpiece W with a large driving force, as compared with the conventional driving method in which the drive roller having a small diameter is in point contact with workpieces. Moreover, since the driving belt 19 is soft and in line contact with the workpieces, it does not damage the workpieces.

Figure 2:
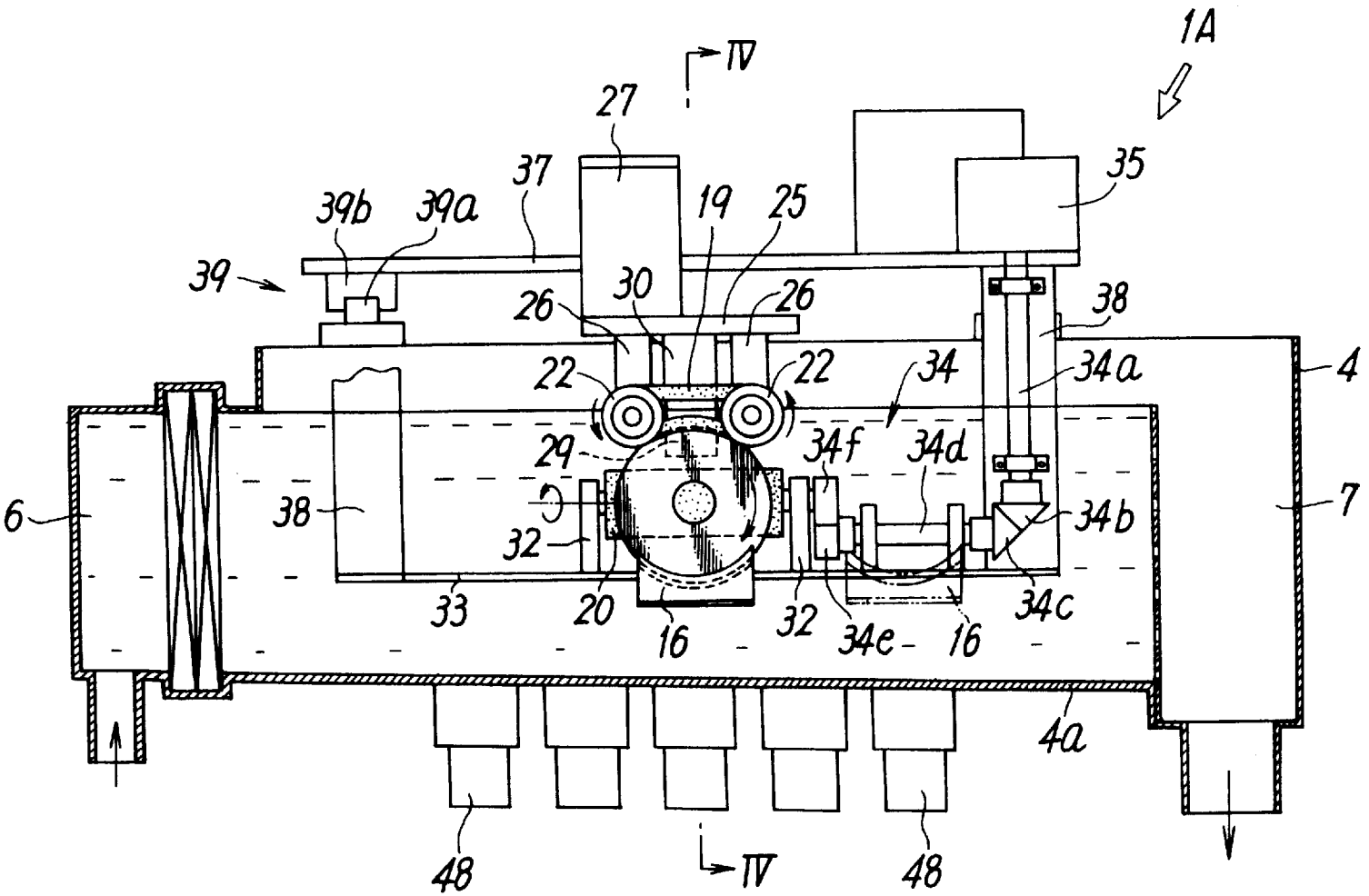
FIG. 2 is a sectional view specifically showing a configuration of a cleaning mechanism of the cleaning apparatus of FIG. 1.
Figure 4:
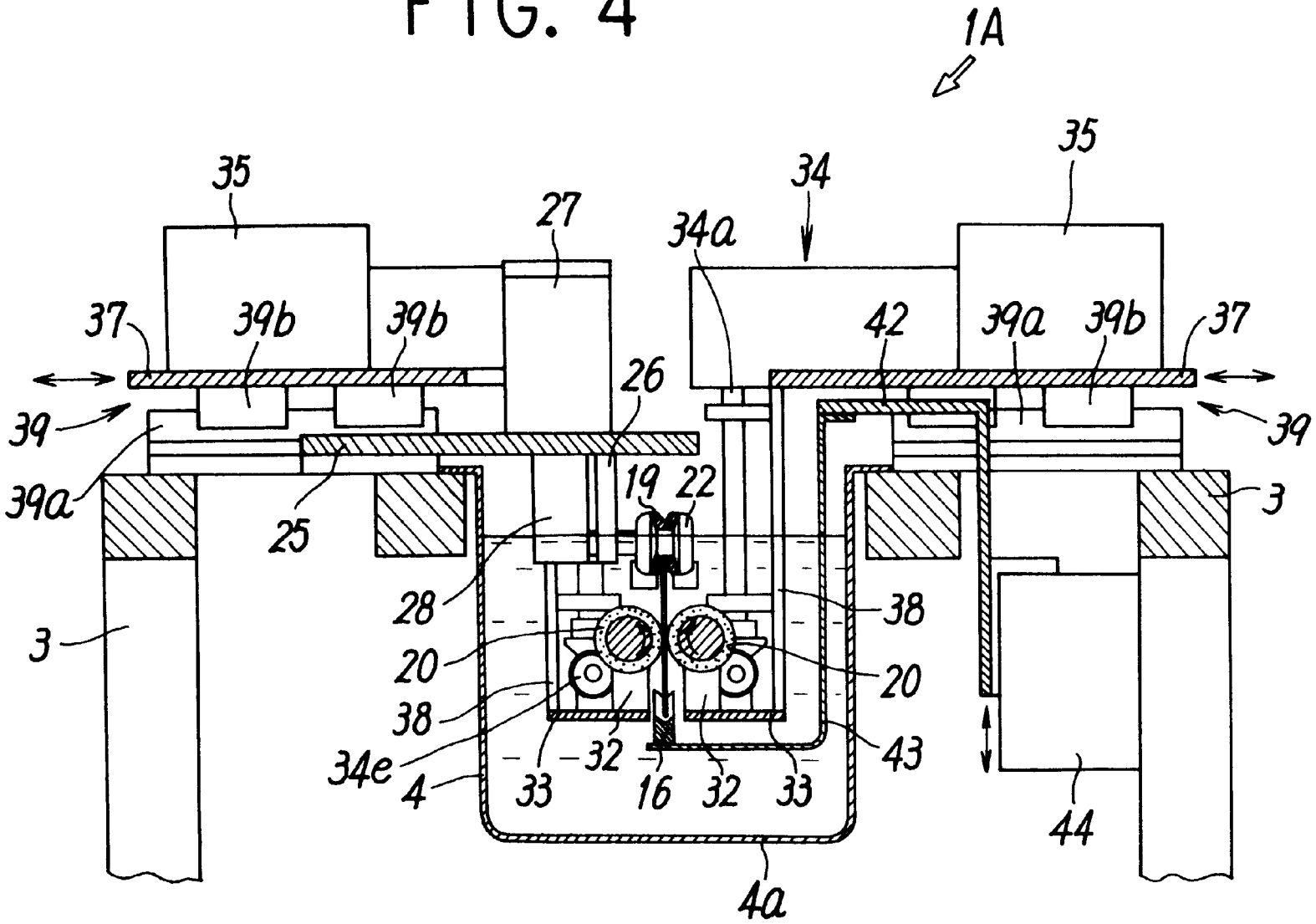
FIG. 4 is a sectional view taken along the line IV—IV in FIG. 2.
Figure 5:
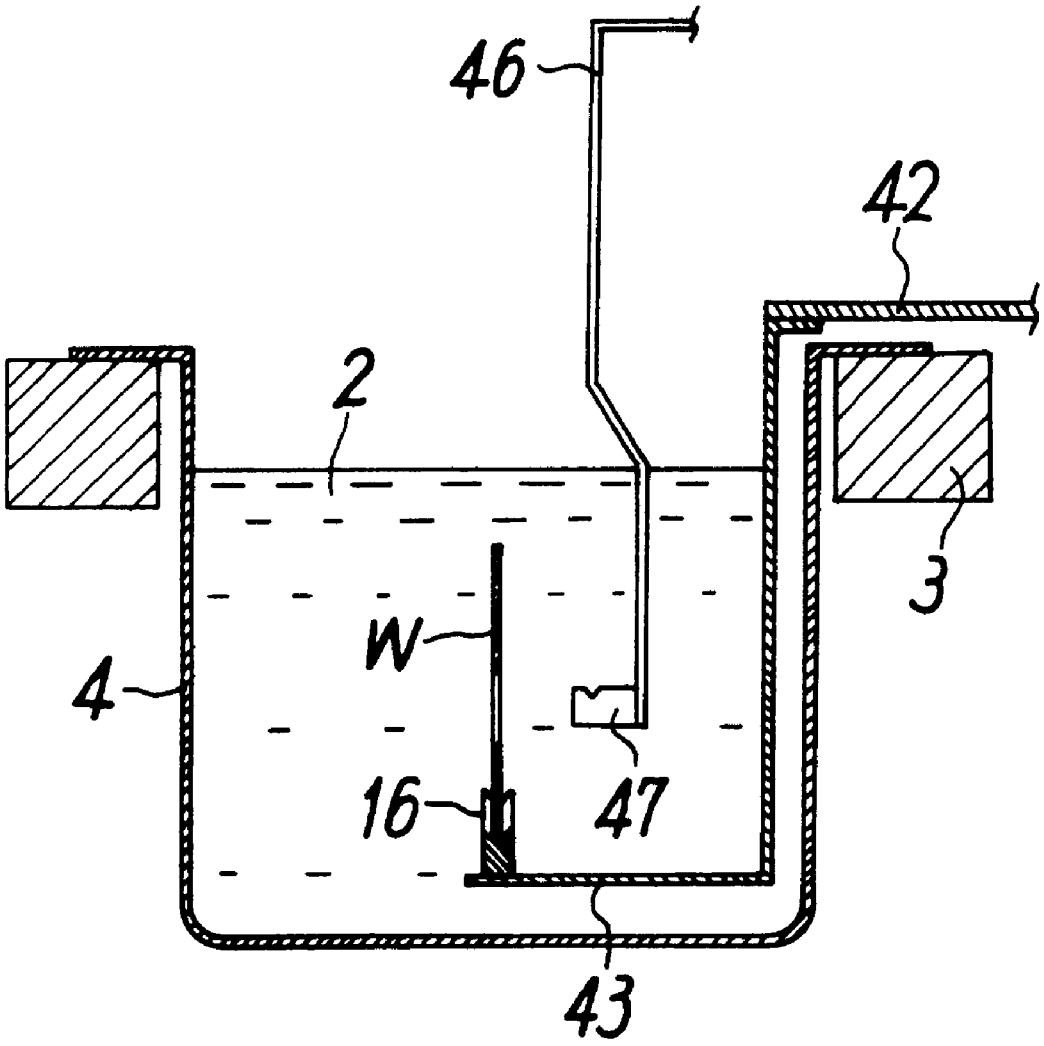
FIG. 5 is a sectional view taken along the line V—V in FIG. 1.

As can be seen in FIG. 2 and FIG. 4, the pulleys 22 are rotatably supported by bearing members 26 that extend into the cleaning tank 4 from a base plate 25 attached to the body 3, and are driven in the directions of the arrows by a motor 27 provided on the base plate 25 through a power transmitting mechanism 28.

Figure 6:
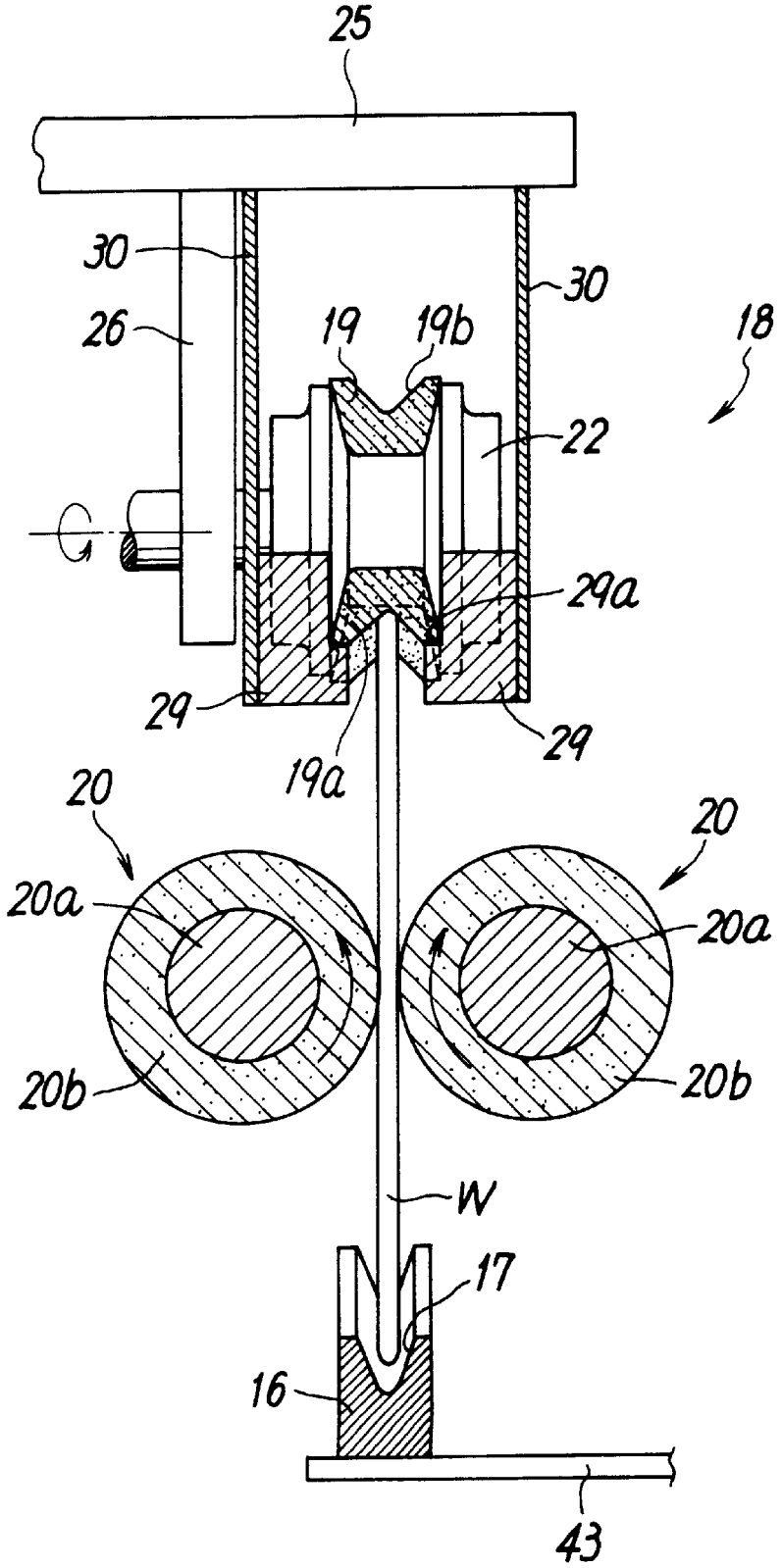
FIG. 6 is an enlarged sectional view of an essential section of the cleaning mechanism.

The driving portion 19*a* of the driving belt 19, which abuts against the workpiece W, is supported in a curved state by a pair of guides 29 and 29 provided between the two pulleys 22 and 22, as can be seen in FIG. 2 and FIG. 6. These guides 29 are installed at the bottom ends of mounting members 30, which extend downward from the base plate 25, so that they oppose each other, clamping the driving belt 19; they have guide surfaces 29*a*, which are curved upward, on respective inner surfaces. The driving belt 19 is brought into slidable contact with the guide surfaces 29*a* to thereby curve the driving portion 19*a* of the belt 19 upward.

At this time, the cleaning rollers 20 are provided in pairs so that they oppose each other with the workpiece W held therebetween at a position substantially directly under the driving belt 19 and substantially diametrically across the workpiece W. The cleaning rollers 20 are formed of cleaning members 20*b* which are made of a spongy or fiberous material or other material that is flexible and has a cleaning property, and which are installed around hard core constituents 20*a*, which are made of a metal or synthetic resin material or the like, at a required thickness. The cleaning rollers 20 rotate with the workpiece W clamped therebetween from both sides to thereby clean both surfaces of the workpiece W.

The respective cleaning rollers 20 are rotatably mounted on supporting plates 33 by bearing members 32, and are coupled to a motor 35 via a power transmitting mechanism 34 so as to be driven in the directions of the arrows during cleaning. The rotational directions of the respective cleaning rollers 20 and 20 at that time are the directions for moving the workpiece W upward by the torque thereof. This causes the workpiece W to be lifted from the workpiece holder 16 and pressed against the driving belt 19 from below. In other words, the cleaning rollers 20 also function as the pressing means for pressing the workpiece W against the driving belt 19.

Thus, by having the cleaning rollers 20 also function as the pressing means obviates the need for providing extra support rollers dedicated for rotatably supporting a workpiece being cleaned; hence, the configuration of the cleaning apparatus 1A is simplified. Moreover, increasing the surface pressure (pressing force) of the cleaning rollers 20 applied to the workpiece W allows the workpiece to be pressed against the driving belt 19 more firmly, permitting synergetic effects in that more positive drive by the driving belt 19 can be achieved and in that the cleaning effect by the cleaning rollers 20 can be also enhanced.

The supporting plates 33 on which the cleaning rollers 20 are mounted are installed at the bottom ends of support arms 38 that extend into the cleaning tank 4 from both ends of bases 37, and the bases 37 are installed in the machine body 3 via a sliding mechanism 39 so that they may move along the width of the cleaning tank 4. The paired cleaning rollers 20 and 20 are moved toward or away from each other by the movement of the bases 37.

The power transmitting mechanism 34 is formed of a first driving shaft 34*a* coupled to the motor 35, a second driving shaft 34*d* coupled to the first driving shaft 34*a* by gears 34*b* and 34*c*, and gears 34*e* and 34*f* that couple the second driving shaft 34*d* and the cleaning rollers 20. These members are installed along the supporting plate 33 and one support arm 38. The sliding mechanism 39 is formed of a rail 39*a* provided on the machine body 3, along the width of the cleaning tank 4, a movable member 39*b* provided on the base 37 side so that it may slide along the rail 39*a*, and a driving means (not shown) for driving the base 37.

In the illustrated example, only one pair of cleaning rollers 20 is provided so that they oppose each other with the workpiece W held therebetween; however, two or more pairs may be provided. The positions of the cleaning rollers on both sides of the workpiece W may be slightly staggered vertically. In short, there are no particular restrictions as long as a plurality of cleaning rollers 20 is provided in positions that allow cleaning of the workpiece W while pressing it against the driving belt 19.

The workpiece holder 16 for conveying the workpiece W has a support groove 17 that is curved in an arc at the upper end thereof to support the workpiece by fitting the bottom end outer periphery of the workpiece in the support groove 17. The number of the workpiece holders 16 is equal to the total number of the cleaning assembly 14 (specifically, the cleaning mechanisms 18), the loading assembly 13, and the unloading assembly 15, minus one (minus two in the illustrated embodiment). These workpiece holders 16A and 16B are respectively installed at the bottom ends of support arms 43, which extend into the cleaning tank 4 from a support board 42 common thereto, with the same interval as an interval L among the respective assemblies 13, 14, and 15 being provided. Furthermore, the support board 42 is coupled to the driving mechanism 44 provided on the machine body 3. This allows the two workpiece holders 16A and 16B to move in synchronization vertically between the positions indicated by the solid lines and the chain lines in FIG. 3, and also to reciprocate by the same distance as the interval L along the cleaning tank 4.

Furthermore, the loading assembly 13 and the unloading assembly 15 are respectively provided with chuck arms 46 equipped with hooks 47 that can be inserted and locked in the central holes of the workpieces W; these chuck arms 46 are connected to driving mechanisms (not shown). Uncleaned workpieces are supplied, and cleaned workpieces are removed automatically by these chuck arms 46.

Figure 3:
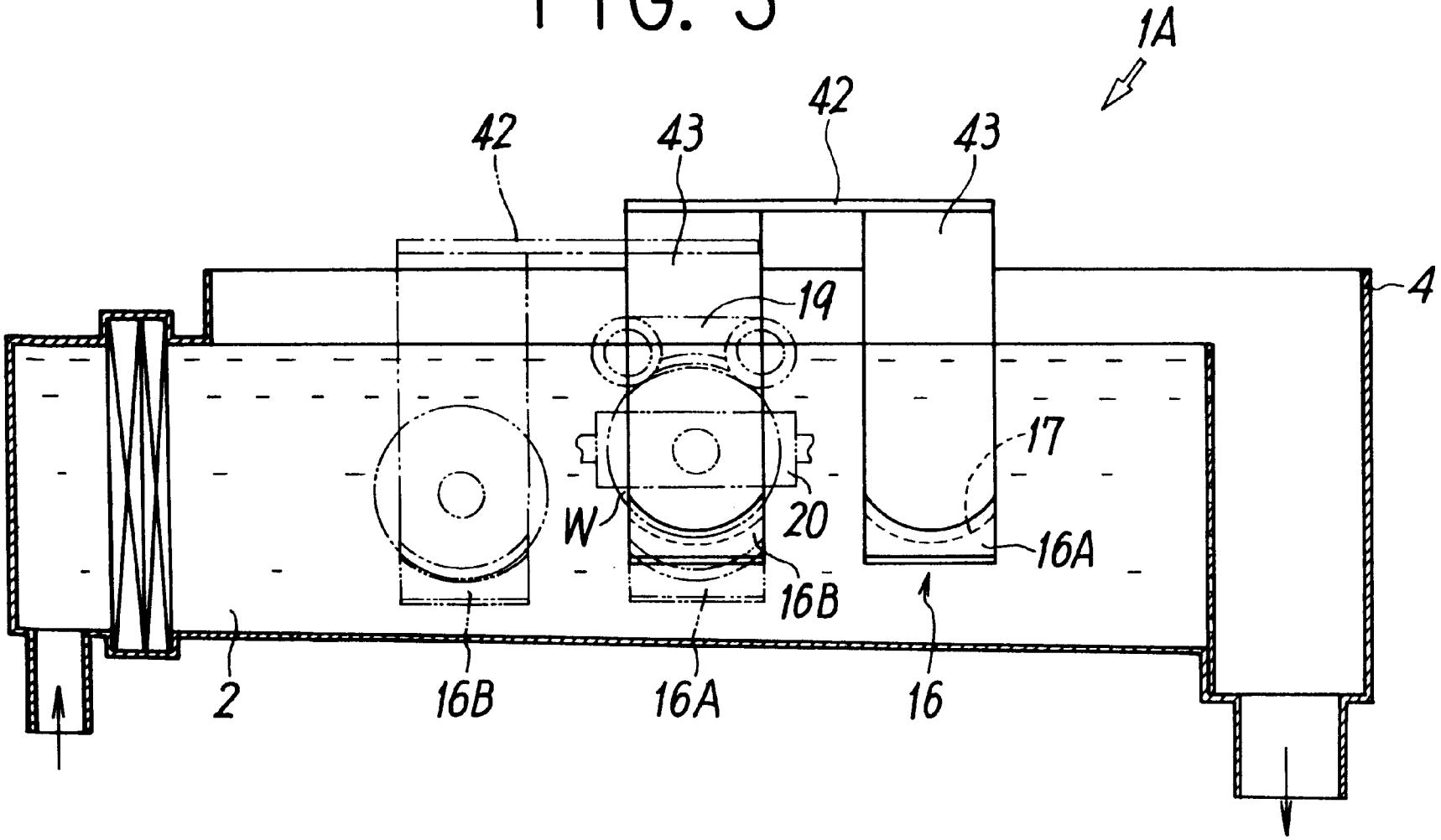
FIG. 3 is a sectional view specifically showing a configuration of a workpiece holder of the cleaning apparatus of FIG. 1.

In the cleaning apparatus 1A having the configuration set forth above, when an uncleaned workpiece W is supplied by the chuck arm 46 to the first workpiece holder 16A, while the two workpiece holders 16A and 16B are in base positions thereof facing the loading assembly 13 and the cleaning assembly 14, respectively, as shown in FIG. 1, these two workpiece holders 16A and 16B move down once, then move toward the upstream side by the interval L so as to move to the advanced position indicated by the chain line in FIG. 3, and at this position, the workpiece holders 16A and 16B move back. This causes the uncleaned workpiece W retained by the first workpiece holder 16A to be fed to the cleaning assembly 14. If the second workpiece holder 16B is holding a cleaned workpiece W supplied from the cleaning assembly 14, then the cleaned workpiece W is sent to the unloading assembly 15.

In the cleaning assembly 14, the pair of cleaning rollers 20 and 20 clamps the workpiece W from both sides and rotates in the directions of arrows in FIG. 1 and FIG. 6 to thereby lift the workpiece W from the first workpiece holder 16A and presses it against the driving belt 19 by the torque thereof. Thus, both surfaces of the workpiece W are scrub-cleaned by the cleaning rollers 20 and 20 while being forcibly rotated by the driving belt 19. At this time, as shown in FIG. 6, the workpiece W is lifted by the torque of the cleaning rollers 20 and 20, is pressed against the driving belt 19, and is away from the first workpiece holder 16A.

Meanwhile, in the unloading assembly 15, the cleaned workpiece W held by the second workpiece holder 16B is taken out by the chuck arm 46.

The two workpiece holders 16A and 16B that have been emptied move down once and retract toward the downstream side, then move up again to their base positions where the first workpiece holder 16A faces the loading assembly 13 and the second workpiece holder 16B faces the cleaning assembly 14, as indicated by the solid lines in FIG. 1.

The above operation is repeated again so as to automatically and continuously convey the workpieces W individually and to clean by scrubbing in the flow of the cleaning solution 2.

In the cleaning tank 4, at least one ultrasonic emitting means 48 for applying ultrasonic waves to the workpieces W being cleaned or conveyed may be installed in an appropriate position.

Figure 7:
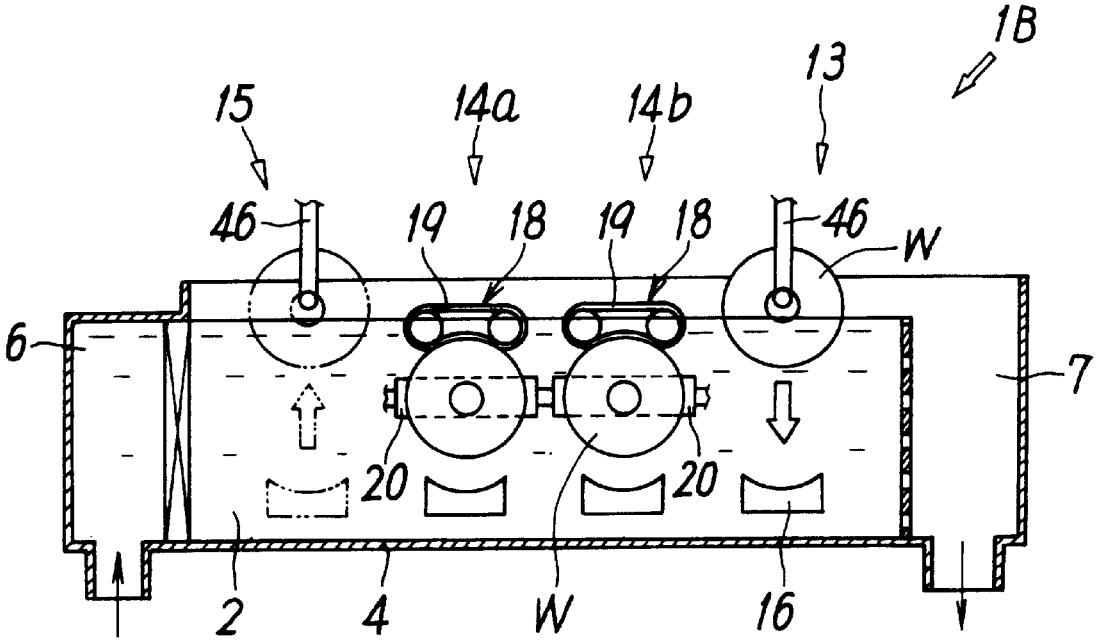
FIG. 7 is a sectional view schematically showing a second embodiment of a cleaning apparatus in accordance with the present invention, employing only major component parts.

FIG. 7 schematically shows a second embodiment in accordance with the present invention. A cleaning apparatus 1B differs from the cleaning apparatus 1A of the first embodiment in that a plurality of cleaning assemblies 14*a* and 14*b* are provided along the flow of the cleaning solution 2. Providing the cleaning assemblies 14*a* and 14*b* in a plurality of stages like this enables cleaning of different levels of accuracy to be accomplished by the respective cleaning assemblies 14*a* and 14*b*. In this case, more workpiece holders 16 will obviously be added according to the number of the cleaning assemblies. Furthermore, the cleaning rollers 20 provided on the respective cleaning assemblies may be individually driven for each cleaning assembly; alternatively, however, the cleaning rollers laterally positioned on the same side of the cleaning tank 4 may be coupled together so as to drive them by a single driving mechanism.

The rest of the configuration and operation is substantially identical to that of the first embodiment; therefore, the same reference numerals as those of the first embodiment are assigned to major identical components and descriptions thereof will be omitted.

Figure 8:
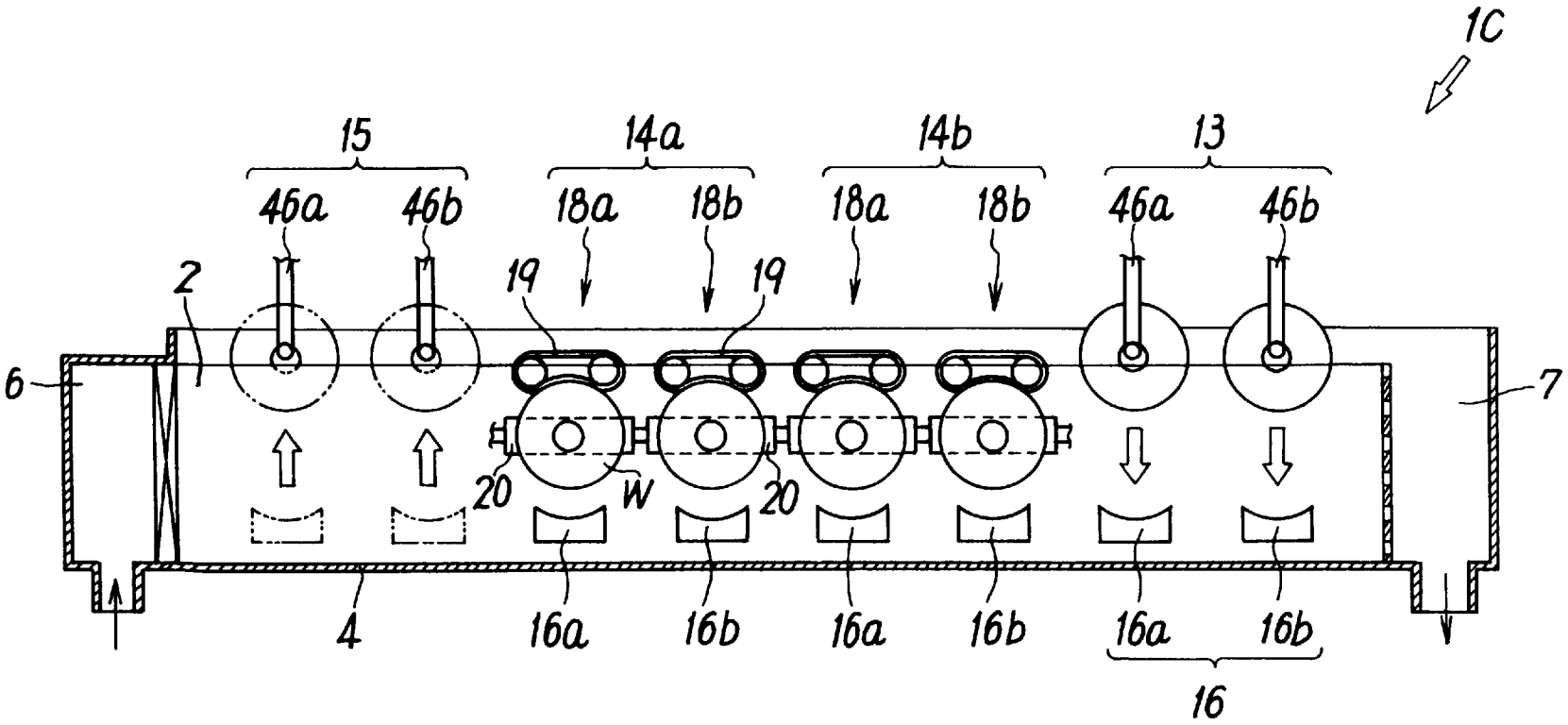
FIG. 8 is a sectional view schematically showing a third embodiment of a cleaning apparatus in accordance with the present invention, employing only major component parts.

FIG. 8 schematically shows a third embodiment in accordance with the present invention. A cleaning apparatus 1C of this third embodiment is similar to the cleaning apparatus 1B of the second embodiment in that it is provided with a plurality of cleaning assemblies. The cleaning apparatus 1C, however, differs from the second embodiment in that each cleaning assembly of the cleaning apparatus 1C is equipped with a plurality of cleaning mechanisms so as to be able to clean each of a plurality of workpieces individually and simultaneously, while each cleaning assembly of the cleaning apparatus 1B of the second embodiment is equipped with only one cleaning mechanism.

More specifically, the cleaning apparatus 1C has two cleaning assemblies, namely, first and second cleaning assemblies 14*a* and 14*b*, and each of the cleaning assemblies 14*a* and 14*b* is provided with two cleaning mechanisms, namely, first and second cleaning mechanisms 18*a* and 18*b*, so that two workpieces W can be cleaned individually and simultaneously.

In this case, the loading assembly 13 and the unloading assembly 15 are also provided with two chuck arms 46*a* and 46*b* to allow two workpieces W to be processed at the same time. Likewise, the workpiece holder 16 is provided with three pairs of workpiece holders, two workpiece holders 16*a* and 16*b* being one pair, so as to carry two workpieces at the same time. The interval provided among the cleaning assembly 14, the loading assembly 13, and the unloading assembly 15 will be 2L; hence, the travel distance of the workpiece holder 16 will be 2L accordingly.

The rest of the configuration is substantially identical to the configuration of the second embodiment.

Figure 9:
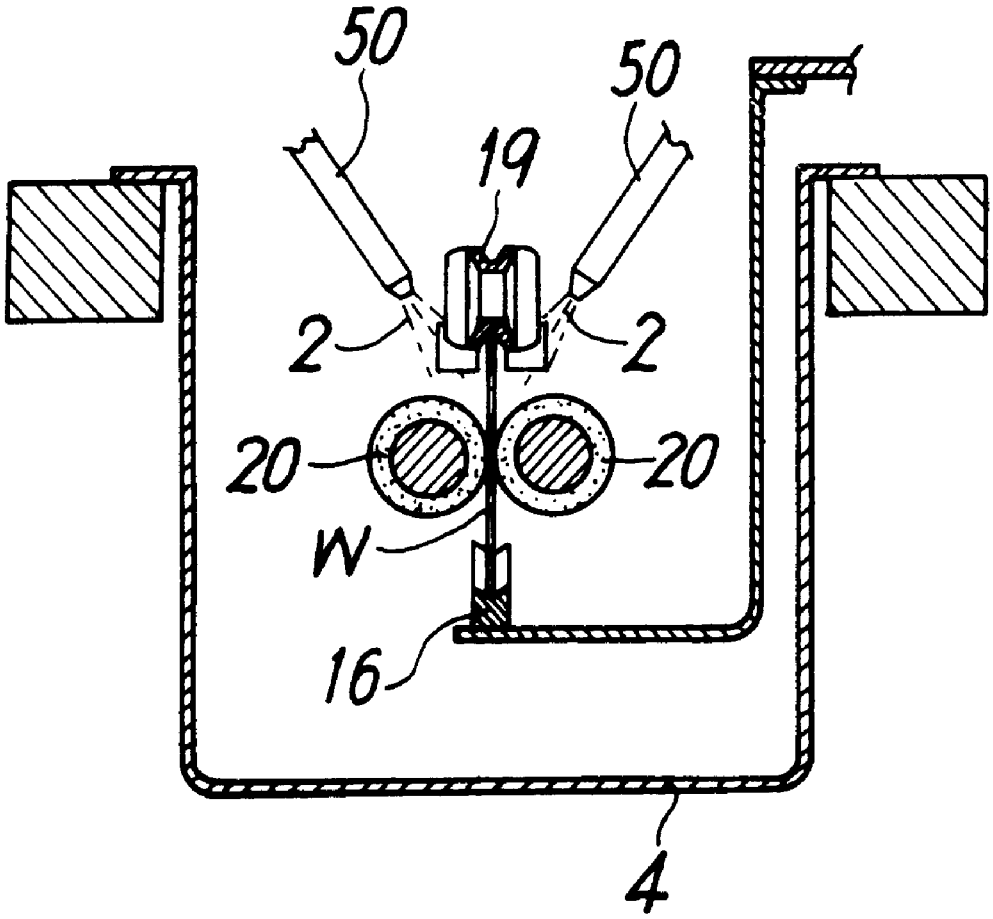
FIG. 9 is a sectional view of an essential section of a fourth embodiment of the cleaning apparatus in accordance with the present invention.

FIG. 9 shows a fourth embodiment of the present invention. A cleaning apparatus 1 of this embodiment differs from the first embodiment in that it is designed to clean a workpiece in a shower stream of the cleaning solution 2 injected from nozzles 50, rather than cleaning the workpiece immersed in the cleaning solution.

The rest of the configuration, namely, the configuration of the cleaning assembly 14, the loading assembly 13, the unloading assembly 15, and the workpiece holder 16, is substantially identical to that of the first embodiment; hence, the same reference numerals as those of the first embodiment are assigned to the same components, and descriptions thereof will be omitted.

Obviously, the shower-type cleaning apparatus 1 may also be provided with a plurality of stages of the cleaning assembly 13 or the cleaning mechanism 18, as in the second and third embodiments.

Furthermore, in all the embodiments set forth above, the workpiece W is pressed against the driving belt 19 only by the torque of the cleaning rollers 20 and 20; alternatively, however, it may be pressed against the driving belt by the workpiece holder 16 in an auxiliary manner. In this case, the grooved bottom of the support groove 17 in the workpiece holder 16 must be formed so as to permit smooth rotation in contact with the work. This may be accomplished by reducing the friction of the grooved bottom surface of the support groove 17 to ensure smooth sliding of the workpiece or by providing the grooved bottom of the support groove 17 with a plurality of rollers or bearings or other rotatable members to support the workpiece at two or three points by the rotatable members.

Thus, according to the present invention, workpieces can be cleaned while reliably rotating them with a large driving force by the endless driving belt, without damaging the workpieces being cleaned.

What is claimed is:

1. A cleaning apparatus for workpieces, comprising at least one cleaning mechanism for individually cleaning workpieces, wherein said cleaning mechanism includes an endless driving belt for forcibly rotating a workpiece around an axis, and a plurality of cleaning rollers for clamping both surfaces of a rotating workpiece from both sides to clean them; and said driving belt has a driving section curved in the circumferential direction of said workpiece, said driving section being configured such that it is brought into linear contact with the outer periphery of said workpiece to rotate said workpiece.

2. A cleaning apparatus according to claim 1, wherein said driving belt has a recess in an outer peripheral surface thereof, extending in the circumferential direction, and an outer peripheral surface of a workpiece is abutted against the belt with said work piece outer peripheral surface engaged in said recess.

3. A cleaning apparatus according to claim 1, wherein at least one pair of said cleaning rollers is provided in opposing positions so as to hold a workpiece therebetween, said cleaning roller serving as pressing means for pressing said workpiece against said driving belt by torque during cleaning of said workpiece.

4. A cleaning apparatus according to claim 1, wherein said driving belt and said cleaning rollers are provided so as to clean a workpiece in a cleaning solution in a cleaning tank.

5. A cleaning apparatus according to claim 1, wherein said cleaning apparatus has a cleaning solution supply nozzle for supplying cleaning solution to a workpiece, and said workpiece is cleaned in a jet flow of the cleaning solution injected from said cleaning solution supply nozzle.

6. A cleaning apparatus for workpieces, comprising:

a solution-flow-type cleaning tank in which a cleaning solution continuously flows from one side to the other side;

at least one cleaning assembly provided along said cleaning tank;

a loading assembly provided at the downstream side of said cleaning assembly to supply an uncleaned workpiece;

an unloading assembly provided at the upstream side of said cleaning assembly to remove a cleaned workpiece; and a plurality of workpiece holders that reciprocate over a predetermined distance among said loading assembly, cleaning assembly, and unloading assembly so as to convey workpieces in sequence to respective components on the upstream side;

wherein each of said cleaning assembly has at least one cleaning mechanism for cleaning workpieces individually; and said cleaning mechanism includes an endless driving belt to forcibly rotate said workpiece around an axis in a cleaning solution and a plurality of cleaning rollers that clamp both surfaces of a rotating workpiece from both sides to clean them in the cleaning solution, and said driving belt has a driving section curved in the circumferential direction of the workpiece, the driving section being brought in linear contact with the outer periphery of the workpiece to rotate said workpiece.

7. A cleaning apparatus according to claim 6, wherein said driving belt has a recess in an outer peripheral surface thereof that extends in the circumferential direction, and an outer peripheral surface of a workpiece is abutted against the belt with said work piece outer peripheral surface engaged in said recess.

8. A cleaning apparatus according to claim 6, wherein one pair of said cleaning rollers is provided such that the cleaning rollers oppose each other with a workpiece held therebetween at a position diametrically across said workpiece and acts as a pressing means to press said workpiece against said driving belt by torque during cleaning.

9. A cleaning apparatus according to claim 6, wherein each of said workpiece holders is configured so that it is able to carry one workpiece by supporting it vertically and in parallel to a solution flow, said driving belt provided so as to abut against an upper outer periphery of said workpiece, and said pair of cleaning rollers is provided between said driving belt and workpiece holder so that the workpiece is lifted from said workpiece holder and is pressed against the driving belt by the torque of said cleaning rollers during cleaning.

* * * * *